US006579179B2

(12) United States Patent
Poole et al.

(10) Patent No.: US 6,579,179 B2
(45) Date of Patent: Jun. 17, 2003

(54) GAMING DEVICE HAVING A CASH OUT MENU SCREEN AND A SYSTEM AND METHOD FOR ENABLING A PLAYER TO RETRIEVE MONEY FROM A GAMING DEVICE

(75) Inventors: Richard W. Poole, Reno, NV (US); Larry R. Hollibaugh, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/819,175

(22) Filed: Mar. 27, 2001

(65) Prior Publication Data

US 2002/0045476 A1 Apr. 18, 2002

Related U.S. Application Data

(63) Continuation-in-part of application No. 09/687,690, filed on Oct. 13, 2000, now abandoned.

(51) Int. Cl.[7] ..... A63F 9/24
(52) U.S. Cl. ..... 463/25; 463/20
(58) Field of Search ..... 463/1, 12, 13, 463/16–20, 25–30, 40–42; 273/292, 293, 143 R, 138.2, 139; 700/91, 92, 93; 235/375, 380, 381, 379; 705/16, 17, 18, 35, 39, 41–45; 902/23

(56) References Cited

U.S. PATENT DOCUMENTS

| | | | |
|---|---|---|---|
| 4,636,951 | A | 1/1987 | Harlick |
| 4,764,666 | A | 8/1988 | Bergeron |
| 4,815,741 | A | 3/1989 | Small |
| 4,837,728 | A | 6/1989 | Barrie et al. |
| 4,882,473 | A | 11/1989 | Bergeron et al. |
| 5,038,022 | A | 8/1991 | Lucero |
| 5,159,549 | A | 10/1992 | Hallman, Jr. et al. |
| 5,179,517 | A | 1/1993 | Sarbin et al. |
| 5,275,400 | A | 1/1994 | Weingardt et al. |
| 5,332,076 | A | 7/1994 | Ziegert |
| 5,342,047 | A | 8/1994 | Heidel et al. |

(List continued on next page.)

FOREIGN PATENT DOCUMENTS

| | | |
|---|---|---|
| GB | 2 096 376 A | 10/1982 |
| GB | 2 142 457 A | 1/1985 |
| GB | 2 161 008 A | 1/1986 |
| GB | 2 161 009 A | 1/1986 |
| GB | 2 180 62 A | 4/1987 |
| GB | 2 181 589 A | 4/1987 |
| GB | 2 183 882 A | 6/1987 |
| GB | 2 222 712 | 3/1990 |
| WO | WO 85/00910 | 2/1985 |

OTHER PUBLICATIONS

Description of Tokeniation Feature in Gaming Machines written by IGT prior to 2000.
Screen of Addams Family Game illustrating Cash Out Button published by IGT (not dated).
Winners Choice Screen published by IGT (not dated).

*Primary Examiner*—Michael O'Neill
(74) *Attorney, Agent, or Firm*—Bell, Boyd & Lloyd LLC

(57) ABSTRACT

The present invention is an operator configurable cash out menu that is displayed when a player presses the cash out button of a gaming device. The present invention provides for more flexible cash outs than in known gaming systems, wherein the player can select one or more methods of payment. The player can select an amount of coins to issue from a coin payout tray. The player can also select an amount of money to issue on a ticket that the gaming device prints and provides to the player, whereby the player can redeem the ticket for cash. The present invention also enables the player to select different amounts of money to cash out. The player can choose: (i) to have some or all of the amount issue as coins from the coin payout tray; (ii) to have some or all of the amount issue as cash printed on a ticket; or (iii) to have some issue as coins and some issue as cash printed on a ticket.

48 Claims, 9 Drawing Sheets

U.S. PATENT DOCUMENTS 5,371,345 A 12/1994 LeStrange et al.
5,377,973 A 1/1995 Jones et al.
5,397,125 A 3/1995 Adams
5,429,361 A 7/1995 Raven et al.
5,470,079 A 11/1995 LeStrange et al.
5,511,781 A 4/1996 Wood et al.
5,559,312 A 9/1996 Lucero
5,639,088 A 6/1997 Schneider et al.
5,674,128 A 10/1997 Holch et al.
5,766,074 A 6/1998 Cannon et al.
5,770,533 A 6/1998 Franchi
5,919,091 A 7/1999 Bell et al.
5,984,779 A 11/1999 Bridgeman et al.
5,993,316 A 11/1999 Coyle et al. ..... 463/25
6,014,594 A 1/2000 Heidel et al.
6,056,642 A 5/2000 Bennett
6,113,098 A 9/2000 Adams
6,125,307 A 9/2000 Heidel et al.
6,128,550 A 10/2000 Heidel et al.
6,139,419 A 10/2000 Abe
6,168,522 B1 1/2001 Walker et al.

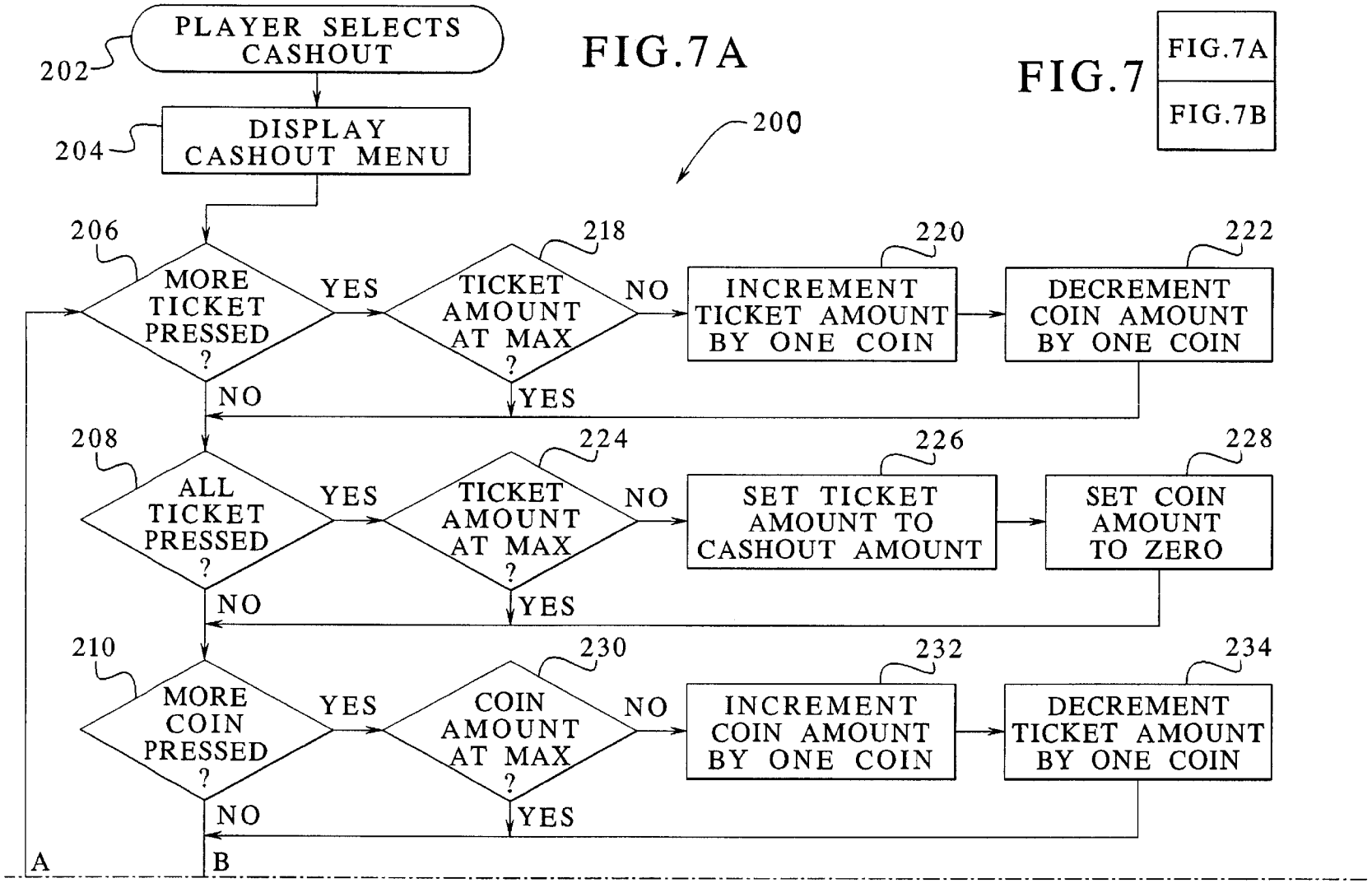
FIG.7A
FIG.7B
FIG.7
FIG.7A
200
PLAYER SELECTS CASHOUT
202
DISPLAY CASHOUT MENU
204
MORE TICKET PRESSED ?
206
YES
NO
TICKET AMOUNT AT MAX ?
218
NO
YES
INCREMENT TICKET AMOUNT BY ONE COIN
220
DECREMENT COIN AMOUNT BY ONE COIN
222
ALL TICKET PRESSED ?
208
YES
NO
TICKET AMOUNT AT MAX ?
224
NO
YES
SET TICKET AMOUNT TO CASHOUT AMOUNT
226
SET COIN AMOUNT TO ZERO
228
MORE COIN PRESSED ?
210
YES
NO
COIN AMOUNT AT MAX ?
230
NO
YES
INCREMENT COIN AMOUNT BY ONE COIN
232
DECREMENT TICKET AMOUNT BY ONE COIN
234
A
B

GAMING DEVICE HAVING A CASH OUT MENU SCREEN AND A SYSTEM AND METHOD FOR ENABLING A PLAYER TO RETRIEVE MONEY FROM A GAMING DEVICE

PRIORITY CLAIM

This application is a continuation-in-part of U.S. patent application No. 09/687,690, filed Oct. 13, 2000 now abandoned.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having a cash out menu screen, wherein a player can selectively retrieve some or all of the amount of money held by the gaming device in one or more forms of payment.

BACKGROUND OF THE INVENTION

It is well known to provide a gaming device, most typically a slot machine or card gaming machine, that accepts money from a player, holds the money while the player plays the gaming device and enables the player to retrieve the player's money at any time. The games preferably do not require the player to input or insert a wagerable amount of money in the gaming device each time the player wishes to play the game. When the player wins while playing known gaming devices, the gaming devices do not require the player to take the winnings and reinvest them into the gaming device if the player desires to continue play. Known gaming devices therefore provide a credit meter or display, which is a mechanism that maintains and displays a pool of money in the gaming device. The pool can store an amount sufficient to play many games of the gaming device. The pool can also accumulate and store the player's winnings. When the player wishes to stop playing, known gaming devices preferably provide a mechanism by which the player can retrieve the money that remains in the pool.

Historically, known retrieval mechanisms include a cash out mechanism, which pays out the player's money in a preferred denomination or form of money. Dollar slot machines (requiring at least a $1 wager) typically issue tokens redeemable for $1 when the player cashes out. Other slot machines can issue actual money such as nickels, dimes, quarters and half dollars. Known slot machines preferably maintain a payout tray limit, such that an operator attendant is called when the player wins or wishes to cash out an amount above the limit. The limit prohibits the player from having to handle a cumbersome or unsafe amount of coins and enables the machine to store a minimal number of coins at any one time.

Other modern slot machines contain a ticketing system, such that the machine issues a ticket to the player that includes the amount of the player's money printed on the ticket. The player can input money using coins, tokens, paper money or credit or debit cards. In one preferred embodiment, when the machine issues the ticket, the player can input the ticket into other gaming machines equipped for redeeming the tickets, or redeem the ticket for money from an operator attendant. The ticketing systems advantageously enable gaming to take place without the player having to handle tokens or coins.

Known retrieval mechanisms generally present an all or nothing proposition to the player. A player needing money from the machine has to retrieve the total amount that has been inputted into the machine. If the player needs less than all the amount from the machine and still desires to play the machine, the player must retrieve the total amount from the machine and re-input the amount with which the player wishes to continue play. A player needing less than all the amount of money from a known ticketing machine, who still desires to play the machine, must retrieve a ticket from the machine containing the total amount that has been inputted into the machine. When a gaming device allows a coin or a ticket payout, a need exists to allow the player to choose between a coin pay, a ticket pay or both.

A need exists for a more flexible cash out or money retrieval system in known gaming machines and more specifically slot machines having modern ticketing systems. Specifically, a need exists in modern ticketing machines to enable the player to retrieve an amount of money in a form immediately usable by the player, e.g., coin money, tickets, or tokens. These amounts enable the player to make monetary transactions such as playing a neighboring machine and tipping an attendant without having to remove all the money from the machine they are playing. A need also, therefore, exists in gaming machines to enable the player to retrieve less than all the money that has been inputted into or won at the machine. In particular, a need exists to enable a player to quickly retrieve a partial definable amount for the player to use without completely cashing out and/or leaving the gaming device.

SUMMARY OF THE INVENTION

The present invention is operator configurable such that the gaming device displays a cash out screen or interface preferably every time the player presses the cash out button of the gaming device. After pressing the cash out button, the game presents a screen of the present invention, which provides for more flexible cash outs than in known gaming systems. The present invention enables the player to select one or more methods of payment. The player can select an amount of coins to issue from a coin payout tray of the game. The player can also select an amount of money to issue on a ticket that the gaming device prints and provides to the player, whereby the player can redeem the ticket for cash, or input the ticket into another gaming machine. It should be appreciated that the present invention is not limited to providing a ticket to the player, but also can be adapted wherein the player can select an amount of money to issue on a credit card, debit card, smart card, note, payout system or any other suitable amount recording device. For purposes of this application, amount recording device includes pay out systems such as hand pay systems and automatic systems which pay out paper money such as dollar bills. A hand pay may be employed for instance when there is not enough coins in the gaming device to pay the player in coins. The gaming machine may notify the player in such case. The amount recording device may further include a memory device which stores an amount of money in a player's account. For purposes of this application, ticket and amount recording device are used interchangeably herein; although the amount recording device includes but is not limited to a ticket and other payout systems.

The present invention enables the player to select different amounts of money to cash out. Depending upon the amount of money a player has in the gaming device, the player can choose: (i) to have some or all of the amount issue as coins from the coin payout tray; (ii) to have some or all of the amount issue as cash represented by a ticket or stored in an amount recording device; or (iii) to have some issue as coins and some issue as cash represented by a ticket or stored in an amount recording device. Preferably, the present invention issues the coins into the coin payout tray first and then the ticket.

The present invention also preferably includes a quick coin feature, which enables the player to obtain an operator configurable amount of coins (e.g., $0.50) in the coin payout tray. The present invention also contemplates a quick coin feature, which enables the player to obtain a player definable amount of coins in the coin payout tray. The present invention also contemplates a quick ticket feature, which enables the player to obtain an operator configurable or player definable ticket payout.

The present invention preferably includes a more coins feature that enables the player to sequentially add coin amounts, in the coin payout tray denomination, to the amount of coins that the game issues. The present invention issues coins in the operator configurable coin payout tray denomination. The amount of coins that the game issues at one time cannot exceed a coin payout tray limit. The present invention also preferably includes a max coins feature that enables the player to easily receive the maximum allowable amount of coins from the game. The maximum allowable amount of coins is limited by: (i) the coin payout tray limit; (ii) the coin payout denomination; and (iii) the current cash out amount.

The present invention preferably includes a more ticket feature that enables the player to sequentially add ticket amounts, in the smallest machine allowable denomination, to the amount of cash that the game issues on the ticket. The smallest machine allowable denomination is the smallest amount of money that a machine can pay by coin, which cannot be smaller than the coin payout tray denomination. The present invention also preferably includes an all ticket feature that enables the player to receive the entire amount of money held in the gaming device on a ticket.

The present invention preferably totals the amount currently selected to be issued as coins and the amount currently selected to be issued on a ticket and displays the totaled amount to the player. The cash out screen of the present invention preferably includes a second executable cash out feature, which is locationally separate from the electromechanical cash out button or selector of the gaming device, and which sends a command to the game to execute the current cash out distribution. The player can also cancel a cash out (except one that is in progress) via a return to game feature.

It is therefore an object of the present invention to provide a gaming device with a cash out menu, wherein a player can selectively and flexibly retrieve some or all of the amount of money held by the gaming device in one or more forms of payment.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIGS. 7A and 7B are schematic flow diagram illustrating an operating method of the cash out menu of the present invention.

DETAILED DESCRIPTION OF THE INVENTION

Gaming Device and Electronics

Figure 1A:
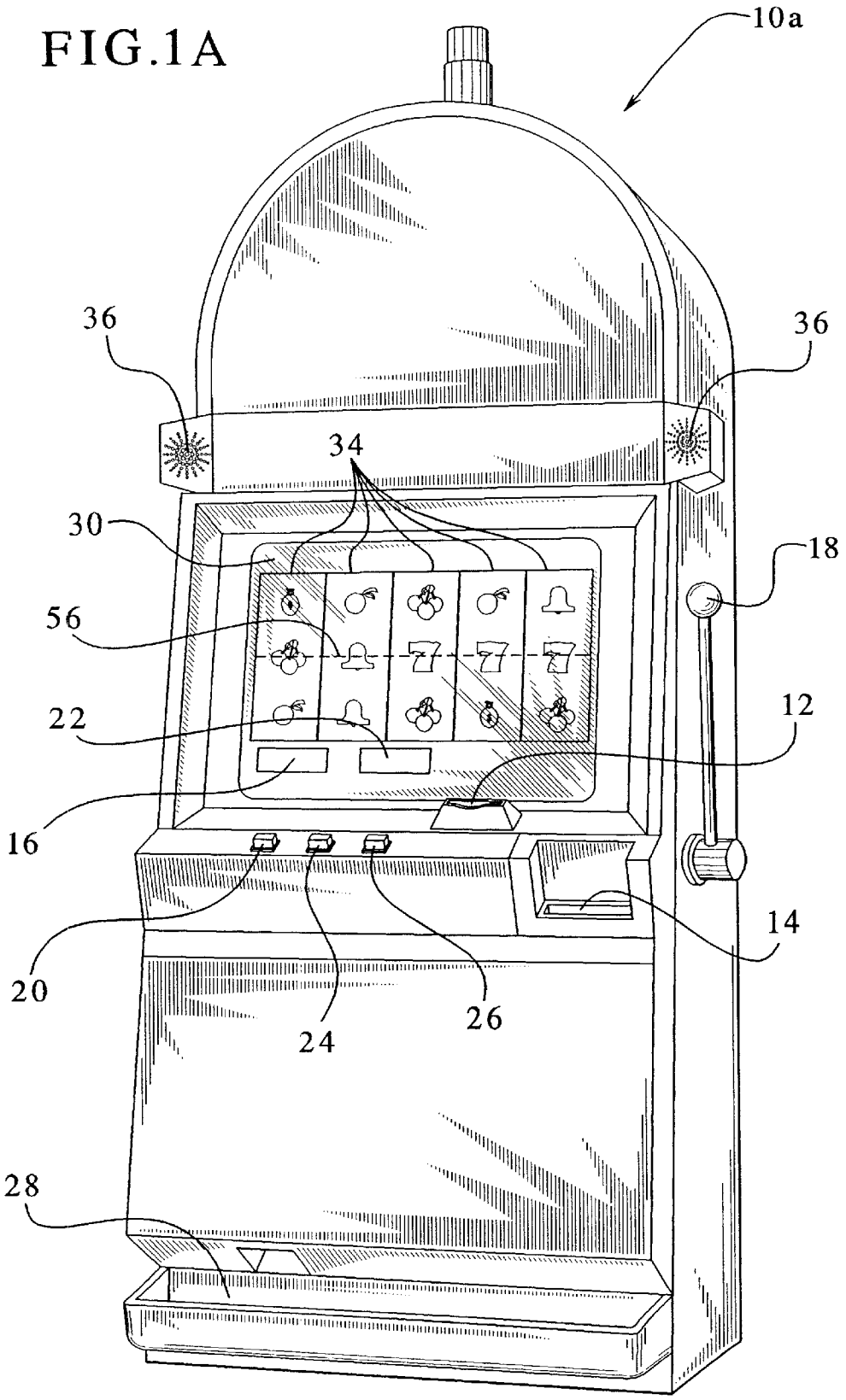
FIG. 1A is a front-right side perspective view of one embodiment of the gaming device of the present invention.
Figure 1B:
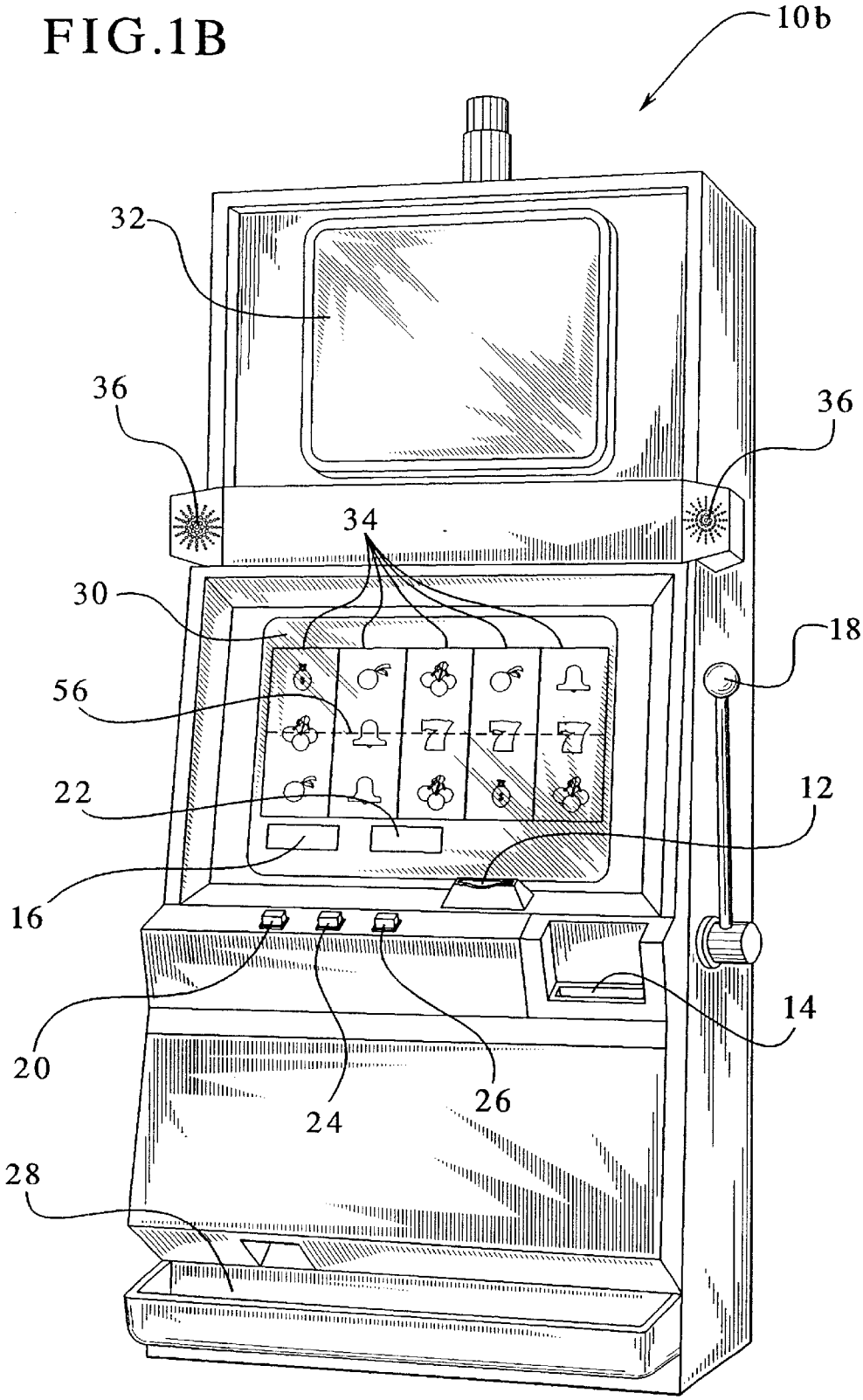
FIG. 1B is a front-right side perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money or a ticket voucher in the bill acceptor 14. Other devices could be used for accepting payment such as readers or validators for credit cards, debit cards, smart cards, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. At any time before or after game play, a player may "cash out" by pushing a simulated, electromechanical or any other suitable cash out button 26 to invoke the cash out menu of the present invention.

Gaming device 10 also includes one or more display devices. The embodiment shown in FIG. 1A includes a central display device 30, and the alternative embodiment shown in FIG. 1B includes a central display device 30 as well as a secondary display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. In a video poker or other card gaming machine embodiment, the display device can display one or more cards. A display device can be any viewing surface such as glass, a video monitor or screen, a liquid crystal display or any other static or dynamic display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
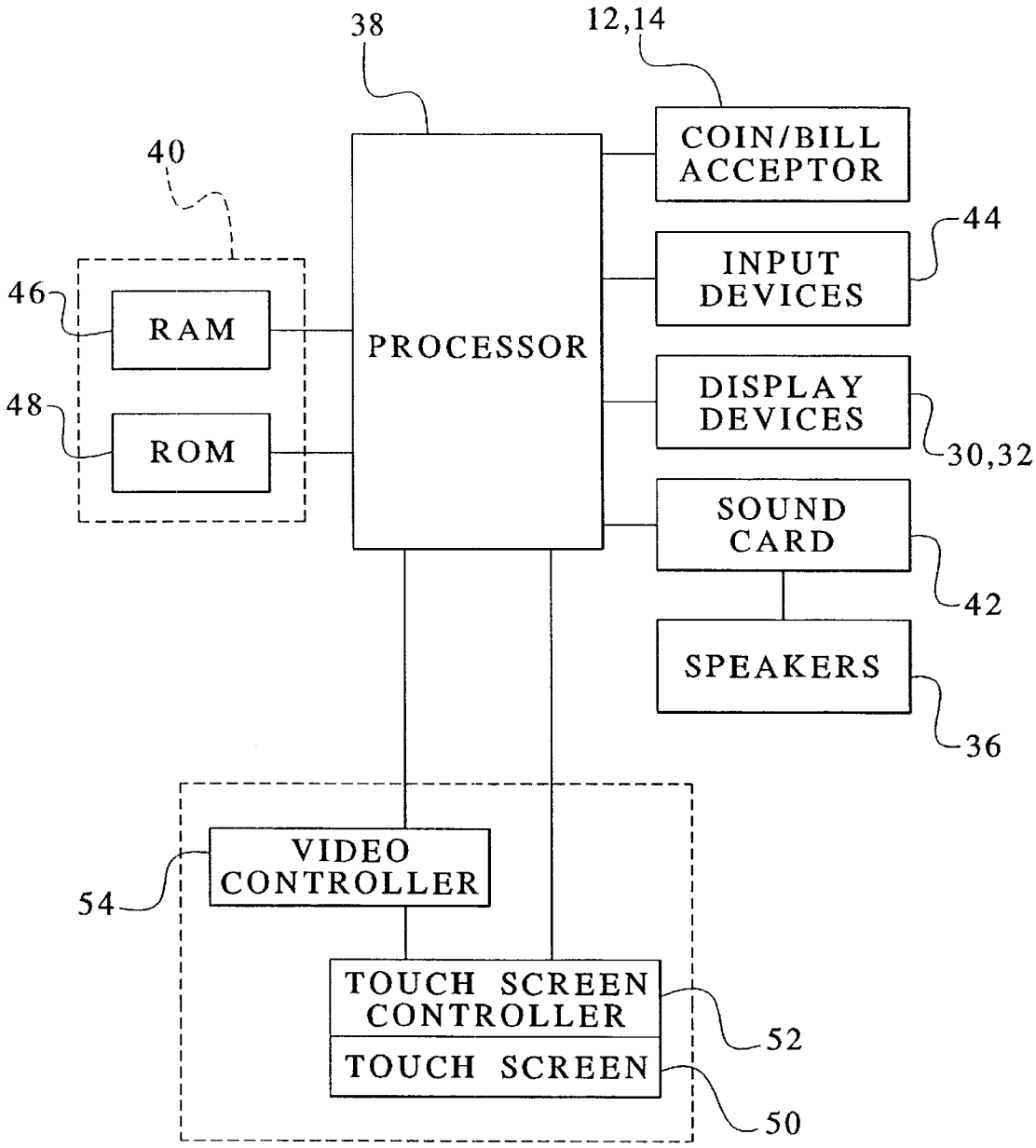
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; one or more display devices 30 and/or 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

It should be appreciated that the preferred embodiment of the present invention includes graphic and sound elements that are used to construct the cashout menu described below. These elements may be stored in EEPROM, flash memory, hard disk, CD ROM or in other suitable storage devices. The cashout menu is preferably constructed in real time when needed. The cashout menu can be displayed on any suitable display device such as a CRT (cathode ray tube), LCD (liquid crystal display), VFD (vacuum fluorescent display), LED (light emitting diode) display, or it could be implemented using only dedicated electromechanical switches.

As illustrated in FIG. 2, the player preferably uses the input devices 44, such as pull arm 18, play button 20, the bet one button 24 and the cash out button 26 to input signals into gaming device 10. In certain instances, it is preferable to use a touch screen 50 and an associated touch screen controller 52 associated with a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 and/or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer" or the "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. Depending upon where the reels 34 stop, the player may or may not win additional credits. As long as the player has the required amount of credits remaining, the player can spin the reels 34 again.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Cash Out Menu of the Present Invention

Figure 3:
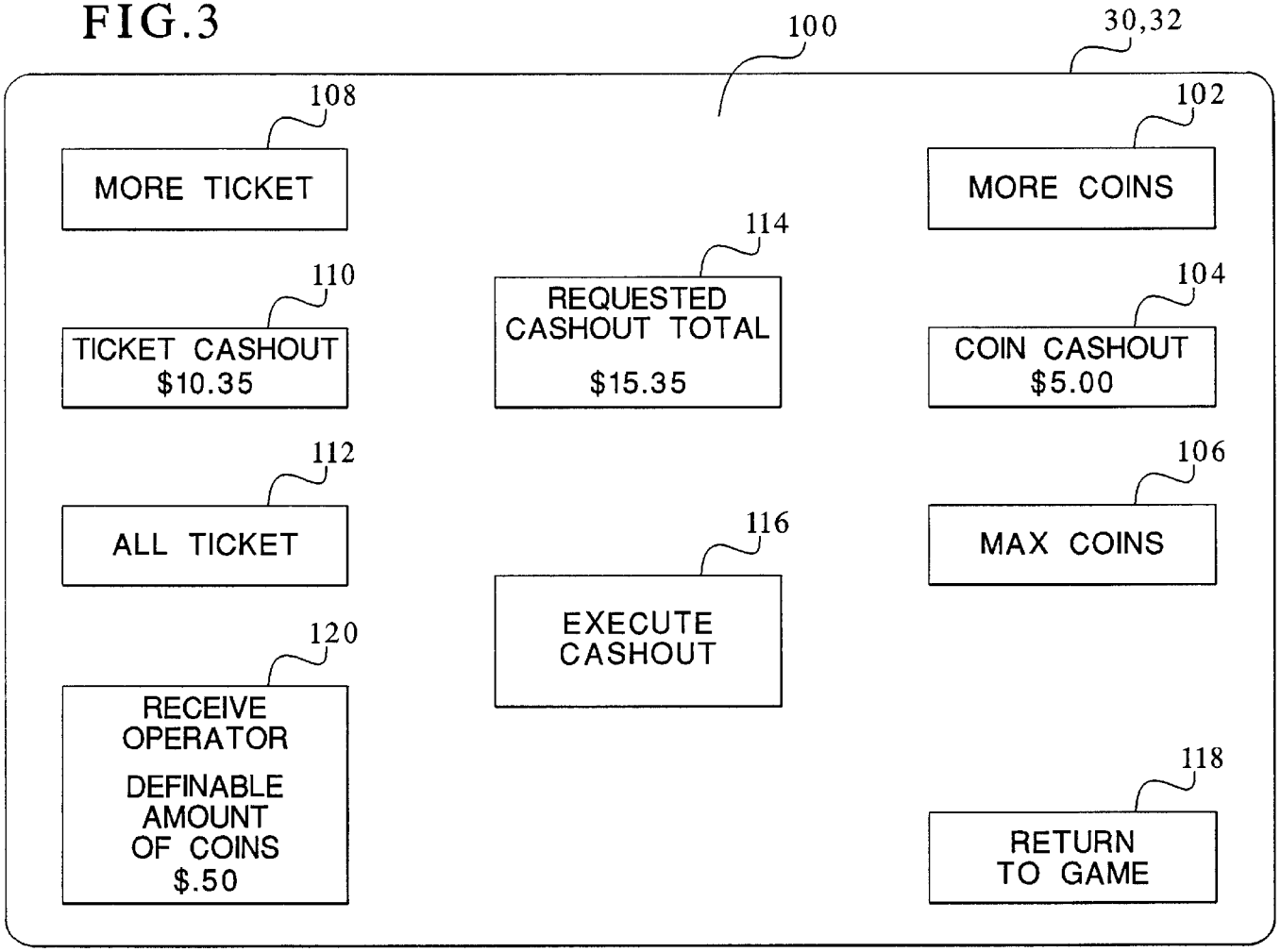
FIG. 3 is an enlarged front elevational view of a display device of the present invention illustrating the preferred cash out menu embodiment.

Referring now to FIG. 3 an enlarged front elevational view of the central display device 30 or the secondary display device 32 of FIGS. 1A and 1B, respectively, is shown illustrating the preferred cash out menu embodiment 100 of the present invention. When the player decides to cash out and selects the cash out button or selector 26 of FIGS. 1A and 1B, the gaming device presents the cash out menu to the player. A method for operating the cash out menu is discussed below in connection with FIG. 7.

The present invention is preferably embodied in a video monitor having a touch screen 50 and an associated touch screen controller 52, as discussed above in connection with FIG. 2. Each of the player selectable buttons or selectors hereafter described is therefore preferably a separate area of the touch screen 50, such that touching that area sends a separate signal or input to the controller of the present invention. Alternatively, the monitor can include only the displays of the present invention, wherein separate electromechanical input devices 44 (FIG. 2) are preferably dedicated to each of the player selectable buttons or selectors.

The cash out menu 100 of FIG. 3 includes a plurality of devices relating to the retrieval of coins or tokens (i.e., money in metal form) from the gaming device 10. As discussed above, slot machines typically employ tokens for wagers of $1.00 or more. Nickel, quarter and half dollar machines typically deal in real money. Depending on the minimum wager of the slot machine, the present invention can issue coins or tokens. Hereafter, if for ease and clarity only "coins" is described or illustrated, it should be appreciated that the present invention refers to both coins and tokens.

The more coins selector 102 of FIG. 3 enables the player to increment the retrieval amount of coins or tokens by the minimum payout tray denomination of the associated slot machine. For a dollar slot machine employing tokens, the more coins selector 102 enables the player to increment the retrieval amount by dollars, e.g., $1, $2, $3, etc. For a quarter slot machine employing quarters, the more coins selector 102 enables the player to increment the retrieval amount by $0.25 (e.g., $0.25, $0.50, $0.75, etc.).

The coin indicator 104 of FIG. 3 displays the current retrieval amount in dollars and cents. For a $1 token machine, the present invention does not preferably display an amount in tokens; rather, the coin indicator 104 preferably automatically converts the number into dollars and cents. The coin indicator 104 preferably updates as the player selects or presses the more coins selector 102.

The max coins selector 106 enables the player to receive the maximum allowable amount of money in the form of coins or tokens. Although the max coins selector 106 relates to coins or tokens, it operates separate from the more coins selector 102. The max coins selector 106 sets as many coins or tokens as possible to the max coin amount immediately after the player selects or presses the max coins selector 106.

The number of coins set by the max coins selector 106 is limited by three constraints, namely: (i) the coin payout tray limit; (ii) the coin payout denomination; and (iii) the total cash out amount. Two examples illustrate the constraints. First, if the player has $2,000 in the machine and desires a coin cash out, but the machine only allows a $1,000 coin cash out, the present invention observes the machine limit and sets the coin amount to a $1,000 coin cash out. The game sets the ticket pay amount to the remaining $1,000. Second, if on a $1 machine the player has $15.35 in the machine and selects the max coins selector 106, the game sets the coin cash out amount to $15.00. The game sets the ticket pay amount to $0.35, as discussed below.

The cash out menu 100 of FIG. 3 also includes a plurality of devices relating to the retrieval of money in the form of a redeemable amount printed on a ticket from the gaming device 10. As discussed above, many modern slot and card machines contain well known ticketing systems that enable a safe reliable payout, which is convenient for large payouts. The system prints out the amount of money to redeem on the ticket. Gaming establishments typically maintain cashiers near the machines to redeem the ticket.

The more ticket selector 108 of FIG. 3 enables the player to increment the retrieval amount of ticket pay by the payout tray denomination of money, i.e., the coin payout denomination. In the example of a dollar slot machine employing tokens, described above, it is conceivable that certain winning combinations of symbols appearing on the reels of multi-denominational gaming devices provide awards in fractions of a token, e.g., in quarters, dimes or nickels. As described above, the coin cash out does not enable fractions of the payout tray denomination. The more ticket selector 108 of FIG. 3, however, is capable of issuing a ticket in a fraction of the payout tray denomination, if necessary. Generally, however, the more ticket selection 108 of FIG. 3 preferably enables the player to increment in the coin payout denomination because the coin indicator 104 and the more coins selector 102 are only able to decrease by the coin payout denomination.

If desired by the implementor, the present invention enables the player to maintain pressure on the selectors 102 and 108 and automatically and continuously pulse incrementing inputs into the controller, so that the player does not have to individually input or press each increment. The present invention can further time the player's input and speed up the pulse rate after a predetermined amount of time, e.g., three seconds, to minimize the time that the player has to maintain pressure. The present invention includes a plurality of pulse accelerations after different predetermined amounts of time.

The ticket indicator 110 of FIG. 3 displays the current retrieval amount in dollars and cents. Again, for a token machine, the present invention does not preferably display an amount in tokens; rather, the ticket indicator 110 preferably automatically converts the number into dollars. The ticket indicator 110 preferably updates as the player selects or presses the more ticket selector 108.

The all ticket selector 112 enables the player to receive the entire amount of money currently available for wager in the form of an amount printed on a ticket. Although the all ticket selector 112 relates to ticket money, it operates separate and apart from the more ticket selector 108. The all ticket selector 112 sets all money that the player has currently available for ticket pay as of the moment the player selects the all ticket selector 112. The coin payout tray limit and the coin payout tray denomination do not limit the all ticket selector 112, as they do the max coins selector. In the example above, wherein on a $1 machine the player has $15.35 inputted into the machine and selects the all ticket selector 112, the game sets the ticket pay amount to the entire amount of $15.35.

The present invention preferably structures the cash out such that the sum of the coin pay amount and ticket pay amount equals the player's total currently stored credits or money, which the game displays in the credit display 16. In the preferred embodiment, when the player selects the more coins selector 102 and increments the coin pay by one coin or token, the game necessarily decreases the ticket pay by one coin or token. Likewise, when the player selects the more ticket selector 108 and increments the ticket pay by one coin or token, the game necessarily decreases the coin pay by one coin or token. In the preferred embodiment, selecting the max coins selector 106 automatically sets the coin pay to a maximum allowable amount as defined by the coin payout tray limit; coin payout denomination; and total cash out amount and sets the ticket pay to the remaining amount, if any, of the player's money. Selecting the all ticket selector 112 sets the ticket pay to the player's total currently stored credits or money, which the game displays in the credit display 16, and sets the coin pay to zero.

In an alternative embodiment, the present invention structures the cash out such that the sum of the coin pay amount and ticket amount does not equal the player's total currently stored money displayed in the credit display 16. In this alternative embodiment, the max coin feature of the max coins selector 106 and the all ticket pay feature of the all ticket selector 112 operate the same as in the preferred structure. In the preferred embodiment, increasing one type of payout necessarily decreases another type of payout, such that the two types add to the player's total stored money. In the alternative embodiment, the more coins selector 102 and the more ticket selector 108 add to an amount initially set to a fraction of a total cashout, e.g., fifty percent of a total cash out. Thus, when the player selects the more coins selector 102 and increments the coin pay by one coin or token, in the alternative embodiment, the game only decreases the ticket pay by one coin or token if the sum of the coin pay and the ticket pay is already equal to the player's total stored money. Likewise, when the player selects the more ticket selector 108, and increments the ticket pay by one coin or token, in the alternative embodiment, the game only decreases the coin pay by one coin or token if the sum of the coin pay and the ticket pay is already equal to the player's total stored money. This embodiment enables the player to take out or receive partial payments from the gaming device and continue to play the gaming device.

The total cash out display 114 indicates the summation of the amount displayed by the coin indicator 104 and the ticket indicator 110. If the player has not inputted a coin cash out amount but has inputted a ticket cash out amount, the total cash out display 114 indicates the ticket cash out amount and vice versa. The player executes either or both a coin cash out or ticket cash out by selecting the cash out executor 116. The game can issue coins first and then the ticket, the ticket first and then the coins or both simultaneously. The game can provide a suitable audio, visual or audiovisual message informing the player to retrieve the ticket.

The return to game or cancel executor 118 enables the player to cancel a cash out before an issuance of coins or a ticket. Thus, at any point before selecting the cash out executor 116, the player can abort the cash out and return to the game. If the player cashes out less than all the money currently inputted into the gaming device, the present invention preferably returns the player to the primary game to resume gaming.

The quick coin executor 120 enables the player to quickly obtain an operator definable amount of coins or tokens from the player's money currently held by the gaming device. The quick coin executor 120 preferably pays out a multiple of the payout denomination. Preferably, the amount is relatively small, e.g., $0.50 to $1.00, to provide a convenient source of money for the player. If the player needs more money, the player can easily select the quick coin executor 120 a plurality of times or execute a coin cash out using the selector 102 and executor 116. The quick coin executor 120 preferably displays the defined amount, illustrated in FIG. 3 as $0.50.

The present invention contemplates the quick coin feature amount alternatively being player configurable or definable rather than operator configurable. In such a case, the present invention includes a separate selector or selectors (not illustrated) enabling the player to increment the quick coin amount in the payout denomination or to type in a multiple of the payout tray denomination. The present invention further contemplates providing both options to the casino operator and enabling the operator to set or choose to have the amount be operator or player configurable.

The present invention further alternatively contemplates the embodiment 100 of FIG. 3, including a quick ticket feature (not illustrated) that enables the player to quickly retrieve an operator or player configurable amount of money onto a redeemable ticket. The embodiment 100 in such a case includes a quick ticket executor, similar to the executor 120, which preferably displays the operator or player defined amount to the player. If the amount is player configurable, this alternative embodiment 100 can also include a separate selector or selectors enabling the player to increment or type in any machine allowable amount. As illustrated above, the operator can preset the ticket amount to be operator or player configurable.

Figure 4:
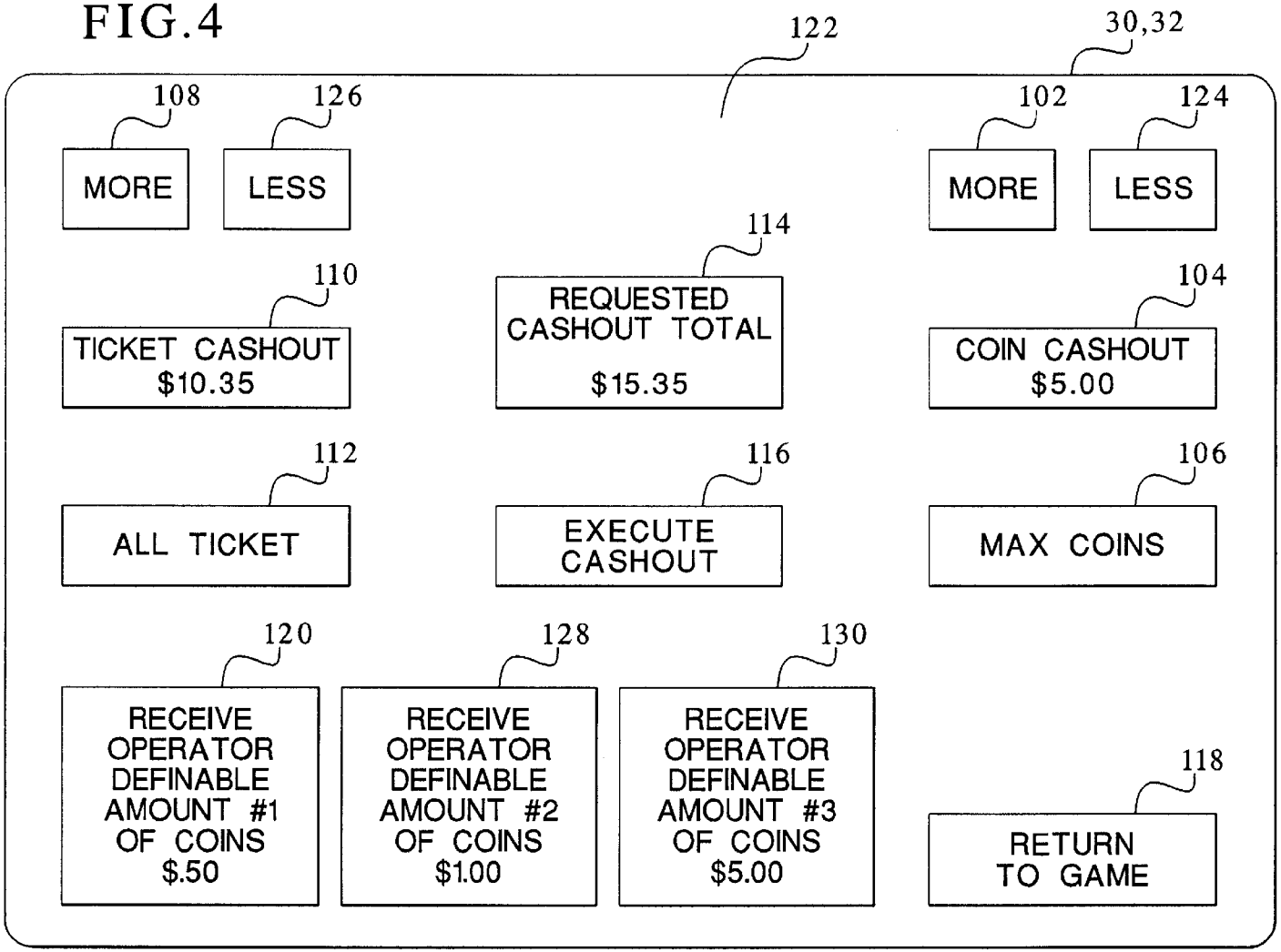
FIG. 4 is an enlarged front elevational view of a display device of the present invention illustrating an alternative cash out menu embodiment.

Referring now to FIG. 4, an enlarged front elevational view of the central display device 30 or the secondary display device 32 of FIGS. 1A and 1B, respectively, is shown illustrating an alternative cash out menu 122 of the present invention. The alternative cash out menu 122 includes a reversing or adjusting feature activated by the less coins selector 124 and the less ticket selector 126. If the player overshoots an amount or has a change of mind, the player can adjust accordingly without having to begin anew. The associated coin indicator 104 and ticket indicator 110 follow and display the player's adjustment accordingly.

The reversing or adjusting feature is particularly useful in situations wherein the player desires to increment a substantial but less than a total cash out. As with the preferred embodiment of FIG. 3, the alternative cash out menu 122 of FIG. 4 includes enabling the player to maintain pressure on the selectors 102 and 108 and automatically and continuously pulse incrementing inputs into the controller, so that the player does not have to individually input or press each increment. The present invention can further time the player's input and speed up the pulse rate after a predetermined amount of time, e.g., three seconds, to minimize the time that the player has to maintain pressure. The present invention includes providing a plurality of pulse accelerations after different predetermined amounts of time.

After accelerating the pulsed incrementing inputs to a certain point, the player may not be capable of stopping the pulses so that the amount indicated by the coin indicator 104 or ticket indicator 110 displays the exact amount desired by the player. The player may overshoot the desired amount. In this case, it is desirable to provide the less coins selector 124 and the less ticket selector 126, or an "alternate more" selector, so that the player can back-up accordingly without having to begin anew.

The alternative cash out menu 122 of FIG. 4 also includes a plurality of quick coin executors 128 and 130, in addition to the executor 120. As stated above, the quick coin executors enable the player to quickly obtain an operator definable amount of coins or tokens from the player's money currently held by the gaming device. Providing a plurality of such executors provides a plurality of operator definable amounts. For example, the alternative embodiment 122 can include the definable amounts $0.50, $1.00 and $5.00 as illustrated by the quick coin executors 120, 128 and 130, respectively. In an embodiment having a quick ticket feature, the alternative cash out menu 122 of FIG. 4 can include a plurality of different operator or player definable quick ticket executors, similar to executors 120, 128 and 130, each of which display and enable a different amount of money to be automatically printed onto or represented by a redeemable ticket or other amount recording device.

Figure 5:
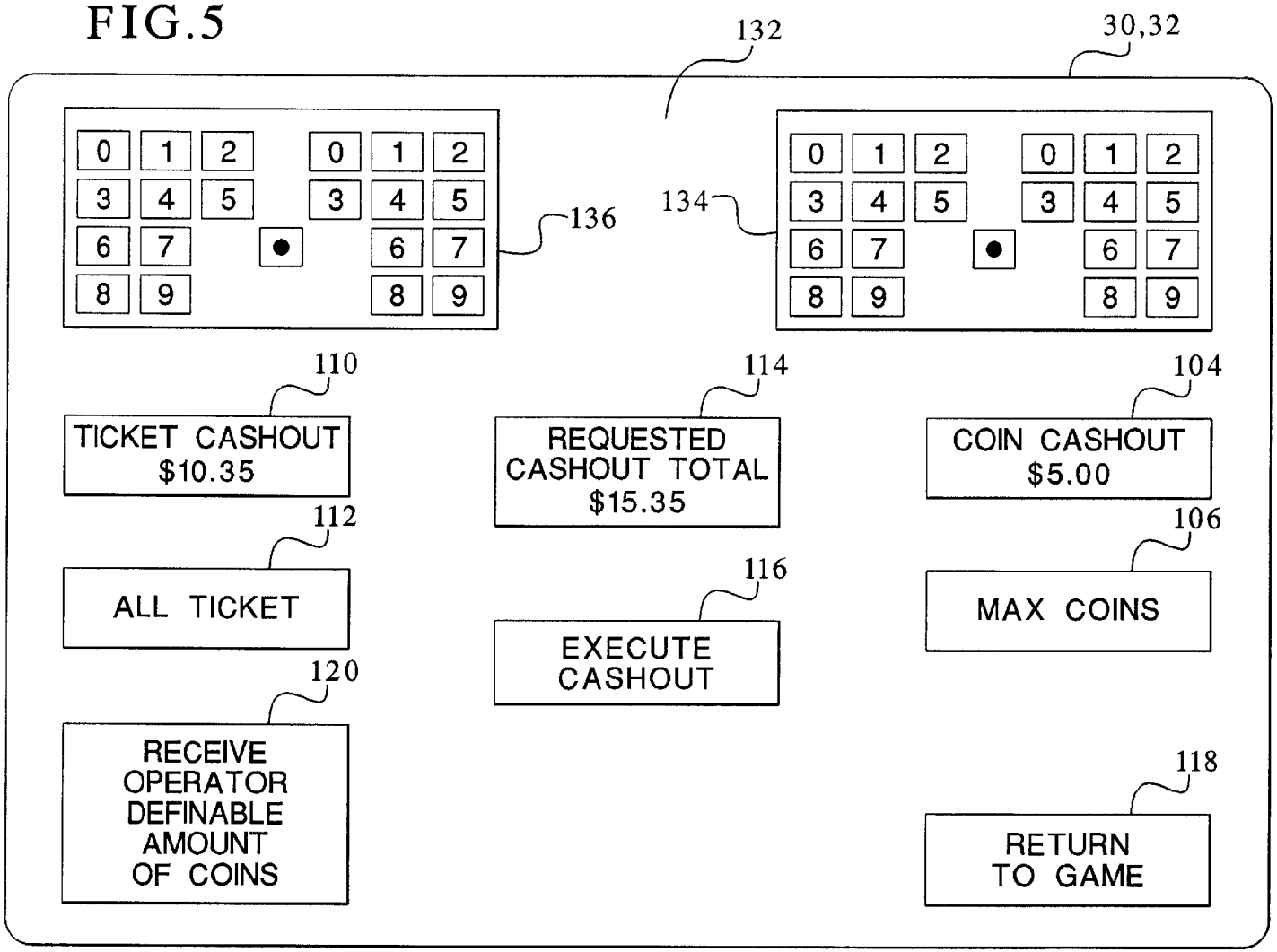
FIG. 5 is an enlarged front elevational view of a display device of the present invention illustrating another alternative cash out menu embodiment.

Referring now to FIG. 5, an enlarged front elevational view of the central display device 30 or the secondary display device 32 of FIGS. 1A and 1B, respectively, is shown illustrating an alternative cash out menu 132 of the present invention. The cash out menu 132 includes an alternative coin selector 134 and an alternative ticket selector 136. For illustration purposes, both selectors include the numerals 0 through 9 on either side of a decimal point. The implementor can configure the alternative selectors in many different ways. In each way, both alternative selectors enable the player to type in the desired amount rather than increment to the desired amount.

Typing in the desired amount can occur in a plurality of ways. The coin indicator 104 and ticket pay indicator 110 could display the player inputted values from right to left and automatically include the decimal point as is done in known automated teller machines (ATM's). The indicators can display the inputted values from left to right, wherein the player types the decimal point in the appropriate place. In this alternative embodiment 132 as well as in the previous embodiments 100 and 122, the present invention preferably provides a suitable audio, visual or audiovisual message when the player inputs an unretrievable amount. The present invention can provide such a message immediately after the player enters the unretrievable amount. Alternatively, the present invention can provide such a message when the player attempts to execute the money retrieval via the cash out executor 116.

It should be appreciated that the present invention can provide a cash out menu having one or more of the features of the cash out menus 100, 122 and 132. For example, the present invention can include a cash out menu having the alternative coin selector 134 and the alternative ticket selector 136 in combination with the additional quick coin selectors 128 and 130. In another example, the present invention can provide the more coins selector 102 and the more ticket selector 108 for a predetermined period of input or until a predetermined amount is reached and then provide alternative coin selector 134 and the alternative ticket selector 136, after a larger desired retrieval becomes apparent. Each embodiment of the present invention preferably includes a max coins selector 106, an all ticket selector 112, a total cash out display 114, a return to game or cancel executor 118 and at least one quick coin executor 120.

As described above with respect to the coin slot 12 and the bill acceptor 14 of FIGS. 1A and 1B, the gaming device 10 of the present invention can also include other devices for accepting payment, including readers or validators for credit cards, debit cards, smart cards, notes, and other amount recording devices. Although not illustrated, it should be appreciated from the above description, that the cash out menu screen of the present invention can be adapted to facilitate any of these alternative methods of payment, including a handpay method wherein an operator pays an amount directly to the player, at the machine and without the need for a ticket redemption.

Referring again to FIG. 3, the present invention contemplates an alternative payment menu embodiment similar to the embodiment 100 wherein the alternative payment menu includes credit card, debit card, smart card, note, handpay indicator or other amount recording devices in addition to or as a replacement for the ticketing apparatus. The alternative payment embodiment can include a more card selector, similar to the more ticket selector 108, that enables an operator definable amount to be credited to an alternative payment card. The alternative payment embodiment can also include a card indicator, similar to the ticket indicator 110, which displays the amount to be credited to the alternative payment card. The alternative payment embodiment can also include an all card selector, similar to the all ticket selector 112, which enables the player to set money that the player has currently available to the alternative payment card. As with the ticket pay, the player is enabled to make a total cashout to the alternative payment card.

The total cash out display 114 in this alternative embodiment includes a display of the amount to be credited to the alternative payment and paid to the player in coins. Likewise, the cash out executor 116 executes an alternative payment cash out along with any coin or ticket cash out desired by the player.

The present invention also contemplates the alternative payment embodiment including a quick card feature that enables the player to quickly credit an operator or player configurable amount to an alternative payment card. The alternative payment embodiment in such a case includes a quick card executor, similar to the executor 120, which preferably displays the operator or player defined amount to the player. If the amount is player configurable, the alternative payment embodiment also includes a separate selector or selectors enabling the player to increment or type in a desired amount. As illustrated above, the operator can preset the card amount to be operator or player configurable. In the alternative cash out menu 122 of FIG. 4, the alternative payment embodiment can include a plurality of different operator or player definable quick card executors, similar to executors 120, 128 and 130, each of which display and enable a different amount of money to be automatically credited to the player's alternative payment card.

Referring again to FIG. 4, the present invention contemplates the alternative payment embodiment including all the features of the alternative cash out menu 122 of FIG. 4. The alternative payment embodiment includes a less card selector, similar to the selector 126, that enables a player to decrease, reverse or adjust a selected amount of money to be credited to an alternative payment card or other amount recording device. Referring to FIG. 5, the present invention contemplates the alternative payment embodiment including all the features of the alternative cash out menu 132 of FIG. 5. The alternative payment embodiment includes a selector, similar to the selector 136 that enables the player to type in the desired amount to be credited from the gaming machine to the player's alternative payment card or other amount recording device.

System of the Present Invention

Figure 6:
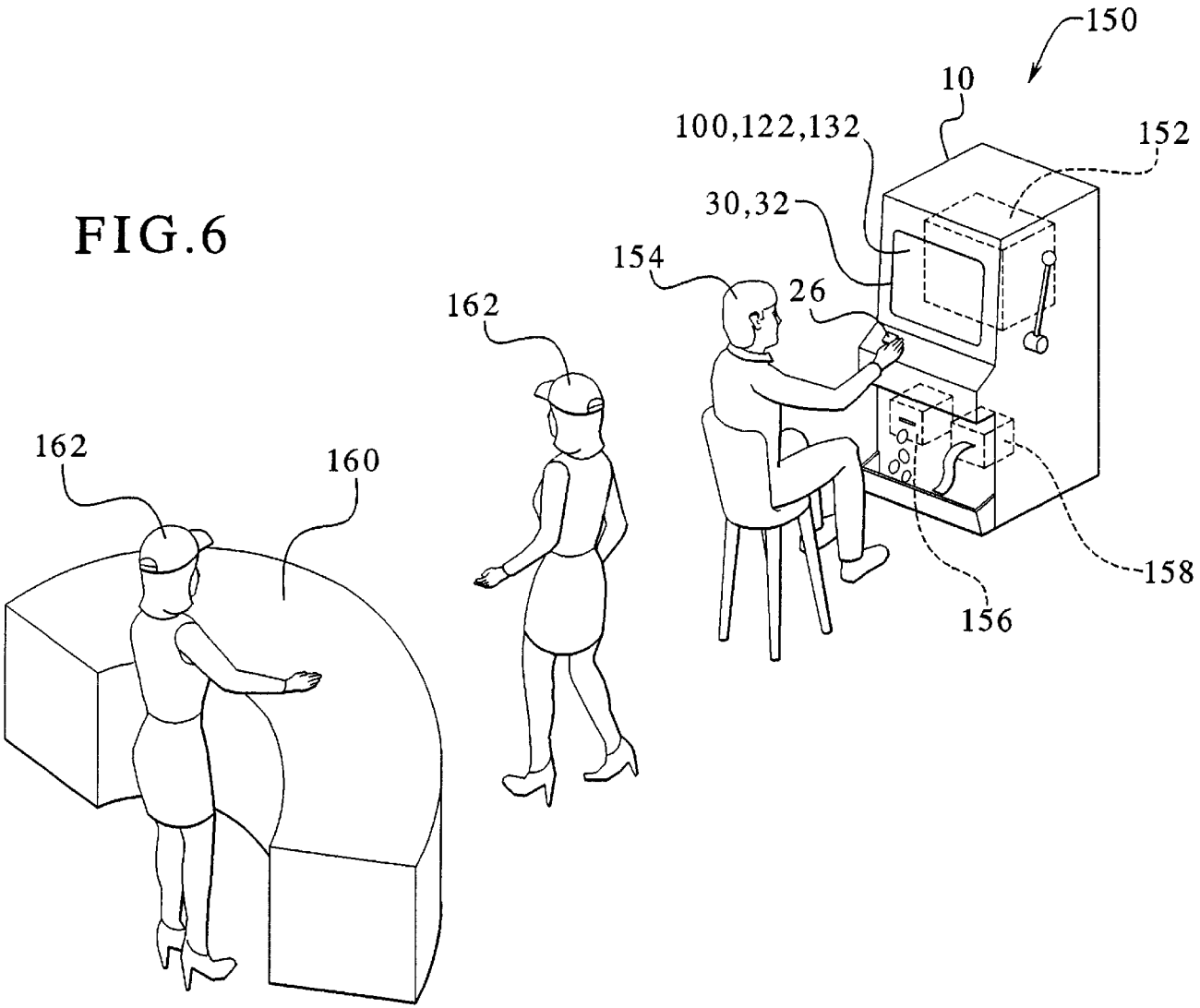
FIG. 6 is a top-front perspective view of a gaming establishment illustrating the money retrieval system employing the cash out menu of the present invention.

Referring now to FIG. 6, a top-front perspective view of a gaming establishment 150 having a money retrieval system employing the cash out menu of the present invention is illustrated. The gaming establishment preferably includes a plurality of gaming devices, such as gaming device 10. The gaming device 10 includes one or both of the central display device 30, secondary display device 32, which communicate with the controller, illustrated schematically in FIG. 2 and shown figuratively and spatially here as the controller 152. One of the display devices 30 or 32 includes or displays one of the cash out menus 100, 122 or 132, or any combination thereof, when the player selects or pushes the cash out button 26. That is, the simulated or electromechanical cash out button 26 is preferably the initial interface by which the player 154 inputs a desire to retrieve at least a potion of the player's money currently held by gaming device 10.

As described above in connection with FIGS. 3, 4 and 5, the present invention enables the player 154 to obtain some or all of the player's money in the form of coins or tokens or in the form of a ticket containing a printed redeemable amount of money. A well known coin issuer or hopper 156 communicates with the controller 152 and issues the appropriate amount of coins or tokens at the appropriate time. One coin issuer 156 preferably handles all coin or token issues including selected coin issues, max coin issues and quick coin issues. A well known ticket issuer 158 communicates with the controller 152 and issues or prints out a ticket including the appropriate or selected amount of money at the appropriate time.

The player 154 receiving coins or cash from the money retrieval system of the present invention can thereafter use the cash as desired. Depending upon the rules of the gaming establishment 150, the player 154 receiving tokens from the money retrieval system of the present invention can typically use tokens the same as cash. If not, and in the case of the player 154 receiving a ticket from the money retrieval system of the present invention, the player 154 can thereafter redeem the ticket and or tokens at one or more cashier stations 160 conveniently located near the gaming devices. The player can leave the gaming device 10 and walk to the cashier stations 160, whereby the player redeems the ticket for the appropriate amount of money from an operator attendant 162. The player can alternatively input a ticket into a different gaming device (not illustrated) of the gaming establishment, wherein the new gaming device includes a ticketing system suitably adapted to receive and read the ticket.

The system of the present invention can also include some or all of the functions of the present invention at a central location such as over a local area network (LAN), wide area network (WAN), Internet connection, etc., as disclosed in connection with FIG. 2. The system network can link to service providers within the gaming establishment 150, such as restaurants, laundry facilities or cosmetic operations or systems such as barber shops or beauty shops. The system network can link to any service provided within the gaming establishment 150, including any associated hotel. The system network can link to outside or third party service providers such as restaurants, hotels or an airline.

Any of the cash out menus 100, 122 or 132 can thus contain features or selections that execute a request for services and/or products relating to those services via the LAN to the gaming establishment and associated hotel 150 or to any outside or third party service via the WAN. Although not illustrated, the features or selectors or the cash out menus 100, 122 and 132 can be included in one screen of the menus or on multiple screens, as desired by the implementor.

Method of the Present invention

Figure 7B:
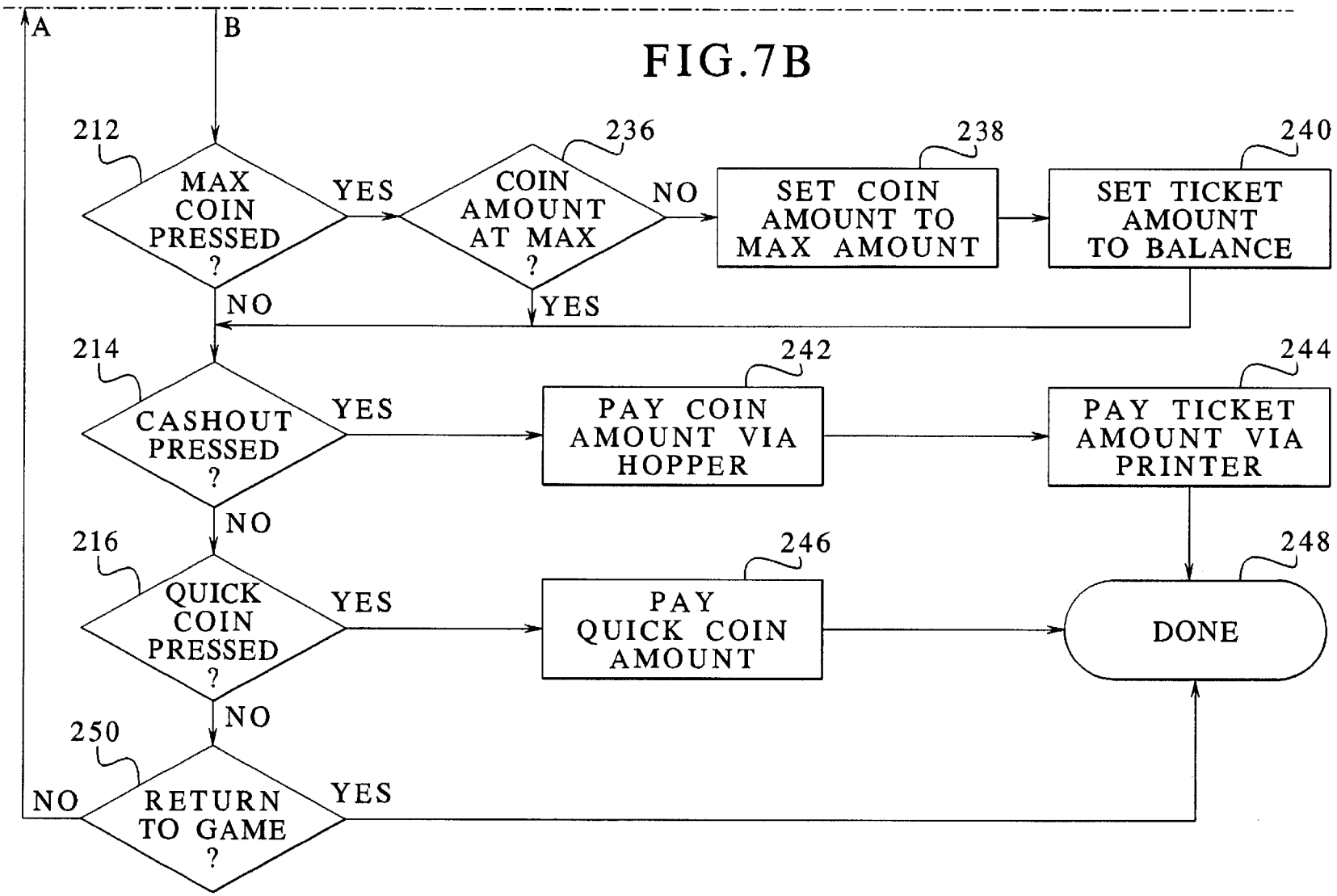

Referring now to FIG. 7, a schematic flow diagram illustrating one operating method 200 of the money retrieval cash out embodiment 100 of FIG. 3 of the present invention is illustrated. FIGS. 3, 4 and 5, illustrating different cash out menu embodiments, provide the methodology for the individual selectors, indicators and executors. FIG. 7 illustrates one possible operating method for the preferred cash out embodiment 100 of the present invention. It should be appreciated that those skilled in the art of computer programming and gaming device design can hereafter create many different but similar operating methods for the embodiments 122 and 132 of FIGS. 4 and 5. The following disclosure is not meant to limit the present invention to the operating method 200 described.

Referring now to the method 200, preferably upon the player's selection of the cash out button, as indicated by the oval 202, the game displays a cash out menu of the present invention, as indicated by the block 204. According to the embodiment 100 of FIG. 3, after the cash out menu is displayed, the player can: (i) increment a ticket amount cash out as indicated by the diamond 206; (ii) select an all ticket cash out as indicated by the diamond 208; (iii) increment a coin amount cash out as indicated by the diamond 210; (iv) select a max coin cash out as indicated by the diamond 212; (v) execute a cash out as indicated by the diamond 214; or (vi) execute a quick coin cash out as indicated by the diamond 216.

Upon an input to increment a machine allowable amount of money for ticket pay, as indicated by a positive response to the query of diamond 206, the game determines whether the current inputted ticket amount is at a maximum level (e.g., total amount of player's money is already inputted), as indicated by the diamond 218. If the inputted ticket amount is at a maximum, as indicated by a positive response to the query of diamond 218, the game cycles to the remaining cash out options. If the inputted ticket amount is not at a maximum, as indicated by a negative response to the query of diamond 218, the game: (i) increments the ticket pay by one coin as indicated by the block 220; (ii) decreases the player's coin pay by one coin as indicated by the block 222; and (iii) cycles to the remaining cash out options.

Upon an input to select an all ticket cash out as indicated by a positive response to the query of diamond 208, the game determines whether the current inputted ticket amount is at a maximum level (e.g., total amount of player's money is already inputted), as indicated by the diamond 224. If the inputted ticket amount is at a maximum, as indicated by a positive response to the query of diamond 224, the game cycles to the remaining cash out options. If the inputted ticket amount is not at a maximum, as indicated by a negative response to the query of diamond 224, the game: (i) sets the amount of money for ticket pay to the player's current credit total (i.e., total indicated on the credit display 16 of FIGS. 1A and 1B) as indicated by the block 226; (ii) decreases the player's coin pay to zero as indicated by the block 228; and (iii) cycles to the remaining cash out options.

Upon an input to increment a payout tray defined denomination of money for coin pay, as indicated by a positive response to the query of diamond 210, the game determines whether the current inputted coin amount is at a maximum level (e.g., payout tray limit or total amount of player's money is already inputted), as indicated by the diamond 230. If the inputted coin amount is at a maximum, as indicated by a positive response to the query of diamond 230, the game cycles to the remaining cash out options. If the inputted ticket amount is not at a maximum, as indicated by a negative response to the query of diamond 230, the game: (i) increments the coin pay by one coin as indicated by the block 232; (ii) decreases the player's ticket pay by one coin as indicated by the block 234; and (iii) cycles to the remaining cash out options.

Upon an input to select a max coin cash out as indicated by a positive response to the query of diamond 212, the game determines whether the current inputted coin amount is at a maximum level (e.g., payout tray limit or maximum coin amount of player's money is already inputted), as indicated by the diamond 236. If the inputted coin amount is at a maximum, as indicated by a positive response to the query of diamond 236, the game returns the player to the remaining cash out options. If the inputted coin amount is not at a maximum, as indicated by a negative response to the query of diamond 236, the game: (i) sets the amount of money for coin pay to the maximum allowable (i.e., maximum increment of payout denomination of player's total indicated on the credit display 16 of FIGS. 1A and 1B or payout tray limit) as indicated by the block 238; (ii) sets the player's ticket pay equal to the player's total less the maximum coin payout amount as indicated by the block 240; and (iii) cycles to the remaining cash out options.

Upon an input to proceed with the selected cash out, as indicated by a positive response to the query of diamond 214, the game pays the player the selected coin pay in the coin payout tray 28 of FIGS. 1A and 1B, as indicated by the block 242, issues a ticket having the selected ticket amount to the player, as indicated by the block 244 and ends the cash out menu sequence, as indicated by the oval 248.

Upon an input to proceed with a quick coin cash out, as indicated by a positive response to the query of diamond 216, the game pays the operator/player selected quick coin amount in the coin payout tray 28 of FIGS. 1A and 1B, as indicated by the block 246 and ends the cash out menu sequence, as indicated by the oval 248. If the machine does not receive an input to proceed with the selected cash out, as indicated by a negative response to the query of diamond 214 or an input to proceed with a quick coin cash out, as indicated by a negative response to the query of diamond 216, the game cycles to the return to game query of the diamond 250.

Upon an input to return to the game, as indicated by a positive response to the query of diamond 250, the game ends the cash out menu sequence, as indicated by the oval 248. If the player does not select to return to the game, as indicated by a negative response to the query of diamond 250, the game cycles to the top of the loop, as indicated by the diamond 206, and repeats the above described method or process.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A gaming device comprising:

a controller;

a wagering game controlled by the controller;

a display device connected to said controller;

an input device connected operably to said controller;

a cash out menu selectively displayed by said display device when a player selects said input device, said cash out menu including means for enabling the player to request an amount of the player's money in two different forms and the amount of said money in each said form, wherein the amount of the player's money is stored by the controller; and means for providing the player the amount of money in each form and in each amount requested by said player using said cash out menu.

2. The gaming device of claim 1, wherein the wagering game is a primary game.

3. The gaming device of claim 1, wherein said means for providing the amount of said player's money includes means for providing an amount of coins or tokens requested by said player.

4. The gaming device of claim 3, wherein the cash out menu includes means for enabling said player to request a maximum amount of coins or tokens.

5. The gaming device of claim 1, wherein said means for providing the amount of said player's money includes means for providing an operator defined amount of coins or tokens.

6. The gaming device of claim 1, wherein one of the different forms includes an amount recording device representing or storing the amount of said player's money requested in said form.

7. The gaming device of claim 6, wherein said amount recording device includes a ticket, a credit card, a debit card, a smart card, or a hand pay indication.

8. The gaming device of claim 1, wherein the cash out menu includes means for enabling said player to request that an amount recording device receive all of said player's money.

9. The gaming device of claim 1, wherein said means for providing an amount of said player's money includes means for providing a player selectable amount of coins or token and an amount recording device having a player selectable amount of the player's money.

10. The gaming device of claim 1, wherein said cash out menu includes means for displaying an addition of a player selectable amount of coins or tokens and a player selectable ticket amount.

11. The gaming device of claim 1, wherein said cash out menu includes means for canceling said player's request.

12. The gaming device of claim 1, wherein said cash out menu includes means for returning to the wagering game.

13. A system for enabling a player to retrieve the player's money from a gaming device, said system comprising:

a controller operable to control the gaming device;

means connected to said controller for inputting a decision to retrieve said player's money;

a display device connected to said controller;

a menu displayed by said display device adapted to indicate a plurality of different forms of payment and enable a player to request an amount of the player's money in one, a plurality of or all of the plurality of different forms of payment;

means for providing the player the requested amount of said player's money in each form requested by the player; and wherein said plurality of different forms include a coin or token payment and an amount recording device payment.

14. The system of claim 13, wherein said means for inputting a decision to retrieve said player's money includes a selector chosen from the group consisting of an electromechanical selector and an area on a touch screen associated with said controller.

15. The system of claim 13, which includes means for issuing a player selectable amount of coins or tokens.

16. The system of claim 13, which includes means for issuing an operator selectable amount of coins or tokens.

17. The system of claim 13, wherein one of the different forms is an amount recording device, said amount recording device selected from the group consisting of: a ticket, a debit card, a credit card, and a smart card.

18. The system of claim 17, which includes means for said player to redeem said amount recording device for said amount of money stored on or represented on said amount recording device.

19. The system of claim 13, which includes a local area or wide area network connection to said controller and means for accessing at least one service provider.

20. The system of claim 19, which includes means for accessing a restaurant, laundry facility or cosmetic operations via said local area network connection.

21. The system of claim 19, which includes means for accessing a restaurant, laundry facility, cosmetic operation, hotel or airline via said wide area network connection.

22. A method for enabling a player to retrieve the player's money from a gaming device, said method comprising the steps of:

(a) enabling said player to selectively request a menu to be displayed on a display device of the gaming device;

(b) displaying said menu to said player upon the player's request, said menu including an indication of a plurality of different forms of payment;

(c) enabling said player to request an amount of the player's money in one of, a plurality of or all of the plurality of the different forms of payment indicated by the menu and the amount in each form using said menu;

(d) providing said requested money to said player in each of the requested different forms of payments; and wherein one of the different forms of payment is coins or tokens.

23. The method of claim 22, wherein one of the forms of payment selected from the group consisting of: a ticket, a debit card, a credit card, and a smart card.

24. The method of claim 22, wherein another one of the different forms is selected from the group consisting of: a ticket, a debit card, a credit card, and a smart card.

25. The method of claim 24, which includes the step of displaying on said menu an amount equal to the sum of said amount of coins or tokens and said amount said amount in said other form.

26. The method of claim 22, which includes the step of enabling said player to request an operator defined amount of coins or tokens using said menu.

27. The method of claim 22, which includes the step of enabling said player to request a maximum allowable amount of coins or tokens using said menu.

28. The method of claim 22, which includes the step of enabling said player to request all of said player's money using said menu via a device selected from the group consisting of: a ticket, a debit card, a credit card, and a smart card.

29. The method of claim 22, which includes the step of enabling said player to cancel said retrieval of said player's money before providing said money to said player.

30. The method of claim 22, which includes the step of enabling said player to request a player selectable amount of coins or tokens using said menu.

31. A gaming device comprising:

a controller operable to control a wagering game device;

a display device connected to said controller;

a cash out menu selectively displayed on said display device upon a player input;

means on said cash out menu for indicating a plurality of different forms of payment and accepting a request to issue an amount of said player's money in one of, a plurality of or all of the plurality of different forms and the amount in each different form; and wherein said means for accepting a request to issue an amount of money includes means for accepting a request for an amount or coins or tokens.

32. The gaming device of claim 31, which includes means for accepting a request to display the cash out menu.

33. The gaming device of claim 32, wherein said cash out menu includes means for accepting a request for a maximum amount of coins or tokens.

34. The gaming device of claim 31, wherein said cash out menu includes means for accepting a request for an operator defined amount of coins or tokens.

35. The gaming device of claim 31, wherein said means for accepting a request to issue an amount of money includes means for accepting a the request for an amount stored on or represented by an amount recording device.

36. The gaming device of claim 35, wherein said amount recording device includes a ticket, a credit card, a debit card, or a smart card.

37. The gaming device of claim 31, wherein the cash out menu includes means for accepting a request for all of said player's money via an amount recording device.

38. The gaming device of claim 31, wherein said cash out menu includes means for accepting a request for an operator definable amount of money via an amount recording device.

39. The gaming device of claim 31, wherein said cash out menu includes means for displaying a requested amount of coins or tokens.

40. The gaming device of claim 31, wherein said cash out menu includes means for displaying a requested amount of money for an amount stored on or represented by an amount recording device.

41. The gaming device of claim 31, wherein said cash out menu includes means for displaying an addition of a requested amount of coins or tokens and a requested amount of money for an amount stored on or represented by an amount recording device.

42. A system for enabling a player to retrieve money of the player, said system comprising:

at least one gaming device including a wagering game;

each said gaming device having a controller associated with said gaming device;

means associated with each gaming device connected to said controller for inputting a decision to retrieve said player's money;

a display device connected to each said controller;

a menu displayed by said display device that indicates a plurality of different forms of payment and enables a player to request an amount of the player's money in one of, a plurality of or all forms of payment from the plurality of different forms of payment;

wherein one of the different forms of payment is coins or tokens; and means associated with each gaming device for providing a requested amount of said player's money in each of the forms requested by the player.

43. The system of claim 42, wherein said system includes means for redemption of said player's money at a different location than each said gaming machine.

44. The system of claim 42, wherein the form is selected from the group consisting of: coins, tokens, a ticket, a debit card, a credit card, a smart card, a note and a hand pay.

45. A method for a player to retrieve a player's money stored by a processor of a gaming device which controls a wagering game, said method comprising:

(a) enabling the player to request a cash out of an amount of the player's money including a first portion of the player's money in coins or tokens and a second portion of the player's money in a ticket form;

(b) paying the first portion of the amount to the player in coins or tokens; and (c) during the same cash out, paying the second portion of the amount to the player in the ticket form.

46. The method of claim 45, which includes the step of providing a menu that indicates the coins or tokens and ticket form and enables the player to request the cash out.

47. The method of claim 46, which includes providing the menu when the player selects a cash out input device.

48. The gaming device of claim 1, wherein at least one of the forms can be subsequently used to play the wagering game.

* * * * *

UNITED STATES PATENT AND TRADEMARK OFFICE

CERTIFICATE OF CORRECTION

PATENT NO. : 6,579,179 B2
DATED : June 17, 2003
INVENTOR(S) : Poole et al.

It is certified that error appears in the above-identified patent and that said Letters Patent is hereby corrected as shown below:

Column 4,
Line 19, change “are schematic flow diagram illustrating” to -- are schematic flow diagrams illustrating --.

Column 8,
Line 54, change “limit; coin payout denomination; and” to -- limit, coin payout denomination, and --.

Column 10,
Line 15, change “can adjust accordingly” to -- can adjust the amount accordingly --.

Column 12,
Lines 5-6, change “the alternative payment embodiment” to -- the alternative-payment embodiment --.
Lines 46-47, change “of the central display device 30,” to -- of central display device 30 and --.
Line 55, change “at least a potion of” to -- at least a portion of --.

Column 16,
Line 7, change “coins or token” to -- coins or tokens --.
Line 27, change “one, a plurality of or all” to -- one of, a plurality of, or all --.

Column 17,
Lines 2 and 44, change “plurality of or all” to -- plurality of, or all --.
Line 10, change “payment selected from” to -- payment is selected from --.
Line 17, change “said amount said amount in” to -- said amount in --.
Line 58, change “accepting a the request” to -- accepting the request --.

UNITED STATES PATENT AND TRADEMARK OFFICE

CERTIFICATE OF CORRECTION

PATENT NO. : 6,579,179 B2
DATED : June 17, 2003
INVENTOR(S) : Poole et al.

It is certified that error appears in the above-identified patent and that said Letters Patent is hereby corrected as shown below:

Column 18,
Line 29, change "one of, a plurality of or" to -- one, a plurality of, or --.

Signed and Sealed this

Fourteenth Day of October, 2003

JAMES E. ROGAN
*Director of the United States Patent and Trademark Office*